US010974952B2

(12) United States Patent
Viladot Gene

(10) Patent No.: US 10,974,952 B2
(45) Date of Patent: Apr. 13, 2021

(54) SYSTEM OF FUEL VAPOR RECOVERY AND USE

(71) Applicant: Fuel Management Technologies, S.L., Barcelona (ES)

(72) Inventor: Richard Viladot Gene, Barcelona (ES)

(73) Assignee: Fuel Management Technologies, S.L., Barcelona (ES)

( * ) Notice: Subject to any disclaimer, the term of this patent is extended or adjusted under 35 U.S.C. 154(b) by 12 days.

(21) Appl. No.: 16/315,418

(22) PCT Filed: Jul. 6, 2016

(86) PCT No.: PCT/ES2016/070506
§ 371 (c)(1),
(2) Date: Jan. 4, 2019

(87) PCT Pub. No.: WO2018/007653
PCT Pub. Date: Jan. 11, 2018

(65) Prior Publication Data

US 2019/0308869 A1 Oct. 10, 2019

(51) Int. Cl.
*B67D 7/04* (2010.01)

(52) U.S. Cl.
CPC ..... *B67D 7/049* (2013.01); *B67D 7/04* (2013.01); *B67D 7/048* (2013.01); *B67D 2007/0494* (2013.01)

(58) Field of Classification Search
CPC ..... B67D 7/04; B67D 7/049; B67D 7/048; B67D 2007/0494
See application file for complete search history.

(56) References Cited

U.S. PATENT DOCUMENTS

| | | | | |
|---|---|---|---|---|
| 2,379,215 A * | 6/1945 | Brinkmann | B65D 90/30 | 422/10 |
| 3,266,262 A | 8/1966 | Moragne | | |
| 5,006,138 A | 4/1991 | Hewitt | | |
| 5,017,240 A * | 5/1991 | Brown | B01D 5/0027 | 134/10 |
| 5,220,799 A * | 6/1993 | Lievens | B01D 5/0081 | 220/88.3 |

* cited by examiner

*Primary Examiner* — Jason K Niesz
(74) *Attorney, Agent, or Firm* — Shook, Hardy & Bacon, LLP

(57) ABSTRACT

The system of fuel vapor recovery and use comprises a condensation module (10) that can connect to a fuel tank (2) of a service station by means of ventilation pipe (1), through which the fuel vapors are displaced to the cryogenic condensation module (10), wherein they are condensed, further comprising the cryogenic condensation module (10) and a return pipe (18) for the condensed vapors to the fuel tank (2), wherein that said cryogenic condensation module (10) comprises a cryogenic vaporizer (11) that lowers the temperature of the vapors by condensing them and a processing element (22) that processes the vapors that have not been condensed in said cryogenic vaporizer (11).

19 Claims, 2 Drawing Sheets

SYSTEM OF FUEL VAPOR RECOVERY AND USE

CROSS-REFERENCE TO RELATED APPLICATIONS

This application claims priority under 35 U.S.C. § 365 to PCT/ES2016/070506, filed on Jul. 6, 2016, entitled "SYSTEM FOR THE RECOVERY AND USE OF VAPOURS FROM FUELS", the entirety of the aforementioned applications are incorporated by reference herein.

The present invention relates to a system of fuel vapor recovery and use in a fuel service station and oil terminals.

BACKGROUND OF THE INVENTION

Conventionally, when a fuel supplying tanker truck that carries a load reaches a delivery site, for example, a service station, the tank is connected by a hose to an underground or overhead fuel storage tank.

The transfer of the fuel may be carried out by gravity or may be pressure assisted. The fuel passes from the tank through a system of ducts to an underground or overhead storage tank, from where the users can access the fuel in the service stations through a separate assembly of ducts.

A service station with moderate activity that comprises approximately six distribution terminals will receive at least one tanker truck per day, while a larger service station, for example, a highway service station can receive about five tanker trucks per day. As a result, this fuel supply process from a tanker truck to the tank is constant.

The space above the level of fuel in the storage tank contains fuel vapors, almost always at a saturated level. When filling the fuel storage tank with the delivery load, these vapors are necessarily displaced and ventilated to the atmosphere through pipes. The unloading of said vapors into the atmosphere is not only costly, but also harmful to the environment and may create a risk of explosion, in addition to the inhalation of or other contact with the fuel vapors that may be dangerous to one's health.

To reduce the effect of this vapor unload, modification of the ventilation system is known so that the vapors displaced during unloading are returned to the storage tank. However, it has been shown in practice that the known systems of fuel vapor recovery are not very efficient. It is common that the fuel recovered is hardly more than 1 or 2 liters per tank, compared to the 35,000 liters of a load from a normal delivery.

The known systems for fuel vapor recovery have high energy consumption, which is negative. Another disadvantage of the systems for vapor recovery of the prior art is that they generate an unacceptable load of highly explosive vapors. In practice, it is likely that a substantial amount of vapors is dispersed through ventilation grilles, and therefore, further contributes to environmental pollution.

It is also possible that, due to the high pressure of vapors, a large part thereof will be unloaded into the atmosphere through a pressure valve.

The system of fuel vapor recovery described in document WO 2009/013544, which comprises the characteristics indicated in the preamble of claim 1, is known. This system comprises a cryogenic cooling system with two-step coalescence to condense the vapors.

Therefore, there is a need to provide an improved system to effectively recover the fuel vapors and prevent the escape thereof into the atmosphere at service stations, and in particular, to improve vapor condensation.

There is also a need for a simplified system that can be easily assembled at existing service stations.

DESCRIPTION OF THE INVENTION

The system of recovery of the invention resolves the aforementioned drawbacks and has other advantages which are described below.

The system of fuel vapor recovery and use according to the present invention comprises a condensation module that can connect to a fuel tank of a service station by means of ventilation pipe, through which the fuel vapors are displaced to the condensation module, wherein they are condensed and processed, further comprising the condensation module and a return pipe for the vapors that are already liquid condensed to the fuel tank for the use and sale thereof, which is characterized in that said condensation module comprises a cryogenic vaporizer that lowers the temperature of the vapors by condensing them and a processing element that processes the vapors that have not been condensed in said vaporizer.

According to a preferred embodiment, said processing element is a coalescing mesh.

Advantageously, said condensation module further comprises a collection tank for the condensed and processed vapors and a shunt arranged between the ventilation pipe and an outlet pipe.

The system of fuel vapor recovery and use according to the present invention further comprises preferably at least one safety valve arranged in said ventilation pipe.

The system of fuel vapor recovery according to the present invention further comprises advantageously a compression module that comprises at least one compressor connected to said cryogenic vaporizer.

Moreover, said outlet pipe may comprises a vent valve and said return pipe may comprise a solenoid valve to automatically unload the condensed and processed fuel to the tank for the use and sale thereof.

Said return pipe further comprises preferably at least one manual valve to manually unload the condensed fuel to the tank.

The system according to the present invention makes it possible to process the water present in the outer air and atmosphere inside the fuel tanks of the service station. The presence of water in the environment is common in some countries where the humidity level may reach 100%.

The system according to the present invention establishes two modules at different temperatures in the cryogenic condensation chamber which allows fractionated condensation of one part of the water vapor and of another part of the most volatile elements of the fuel vapors.

Advantageously, said first and second modules of said cryogenic vaporizer and said processing element are arranged in series for the bidirectionality of the vapors and the air.

The system according to the present invention makes it possible to process the water evaporated in the environment and thus separately work on the water vapor and the fuel vapors to be treated in the cryogenic condensation chamber. The presence of water in the condensation chamber would drastically modify the performance of the system.

The inclusion of valves and the shunt make it possible to improve and optimize safety and performance of the system.

BRIEF DESCRIPTION OF THE DRAWINGS

For the purpose of helping to make the foregoing description more readily understandable, it is accompanied by a set of drawings which, schematically and by way of illustration and not limitation, represent an embodiment.

DESCRIPTION OF A PREFERRED EMBODIMENT

Figure 1:
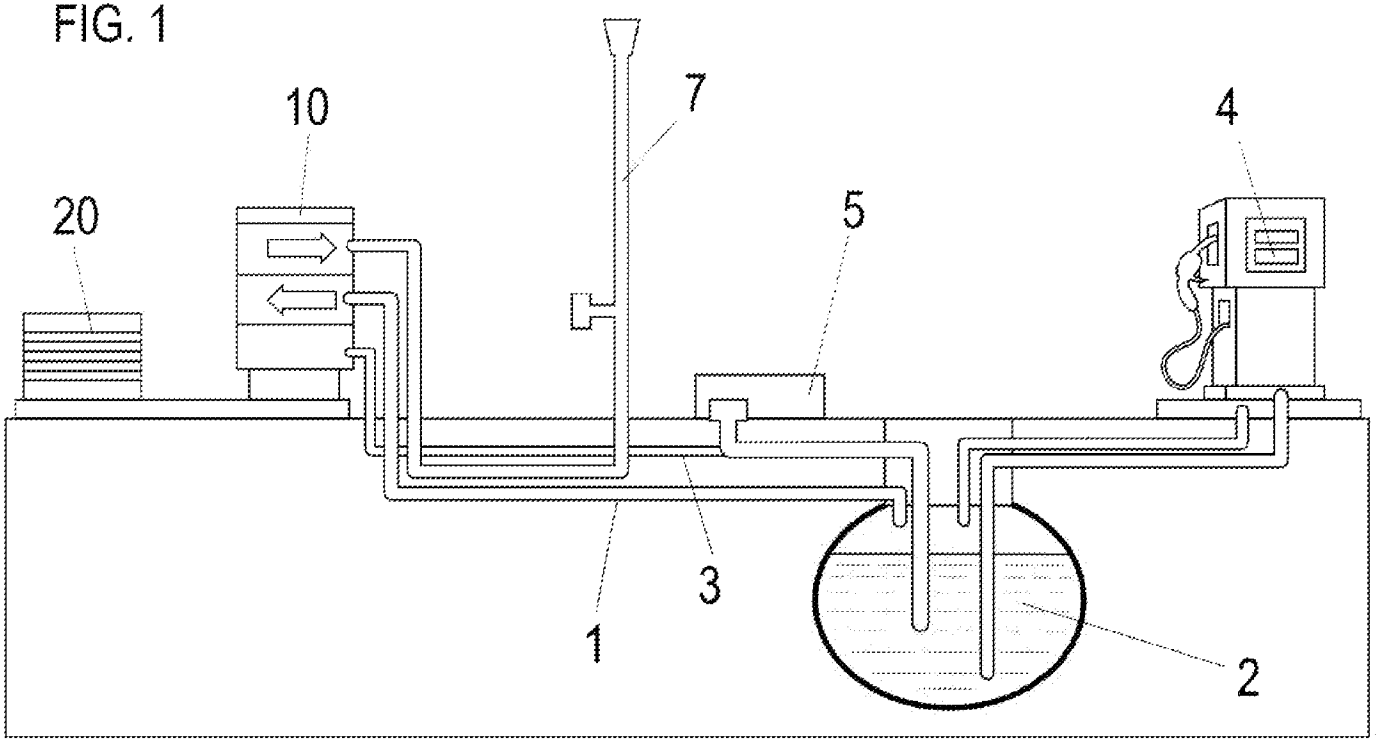
FIG. 1 is a schematic view of a service station that includes the system of vapor recovery according to the present invention.
Figure 2:
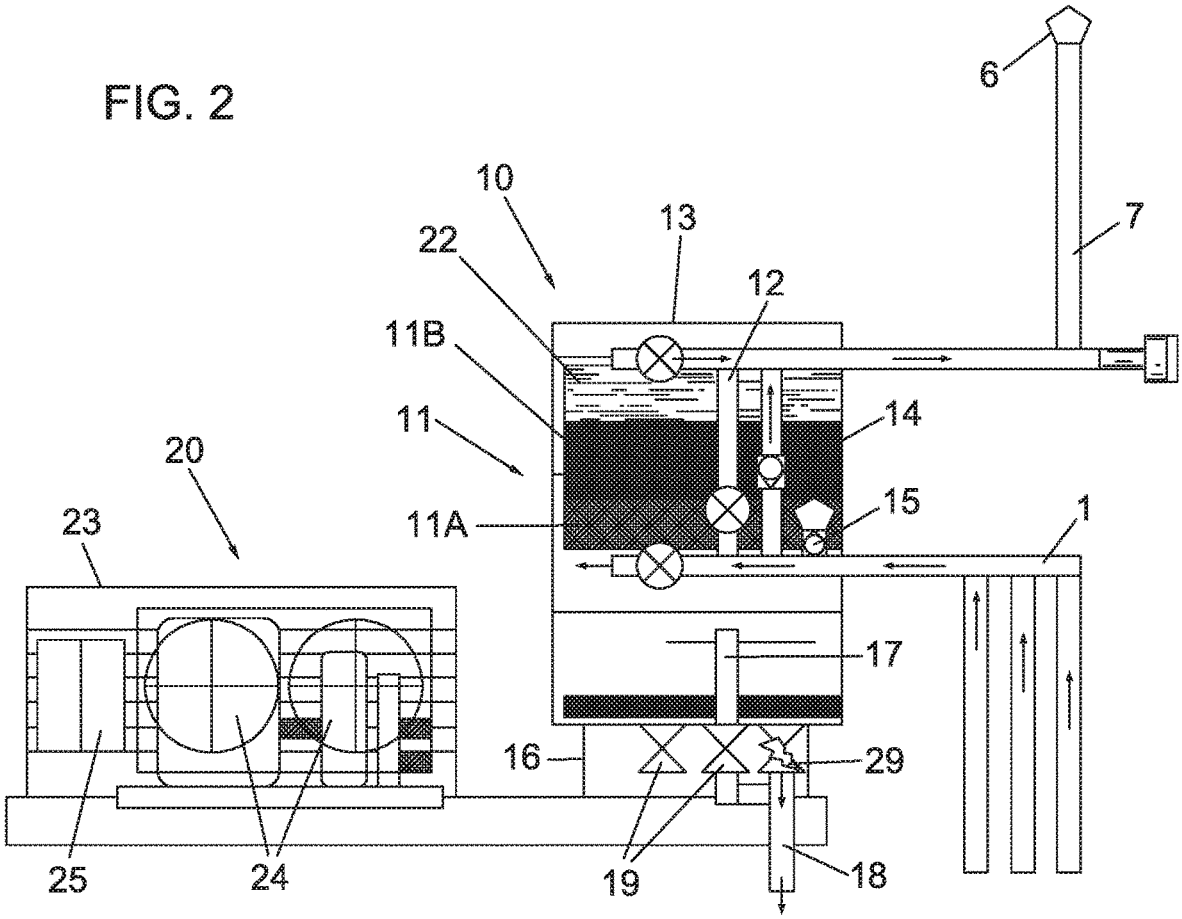
FIG. 2 is a schematic view of the system of vapor recovery according to the present invention.

FIG. 1 schematically shows a service station that includes the system of vapor recovery and use according to the present invention.

The system according to the present invention is installed on a ventilation pipe 1 of a fuel tank 2 at a service station. This ventilation pipe 1 can have different shapes and different components due to the type of installation with which they must comply according to the laws of each country. These types of ventilation pipes do not affect the installation of the system according to the present invention.

A fuel dispenser 4 connected to the fuel tank 2, through which the user loads their vehicle with fuel, is also installed at the service station. Moreover, the service station further comprises a fuel supply base 5 connected to the tank 2, wherein a tanker truck is placed to supply fuel to said tank 2.

The system according to the present invention further comprises a return pipe 3 of the recovered product to the fuel tank 2 of the service station.

In particular, the system according to the present invention comprises two modules installed on the same base plate: a cryogenic condensation module 10 and a compression module 20.

As seen in FIG. 1, the cryogenic condensation module 10 is connected to the tank 2 by means of said ventilation pipe 1, such that the vapors from the tank 2 enter the condensation module 10 by means of said ventilation pipe 1.

The condensation module 10 comprises a sealed chamber 13, wherein the vapors are processed, the temperature thereof being lowered by means of a cryogenic vaporizer 11.

The cryogenic vaporizer 11 comprises two different modules that process, in a first step, the possible moisture that the vapors that pass through it may contain, and in a second step, the fuel vapors previously cleaned of the possible moisture.

The first module of the cryogenic vaporizer 11A makes it possible to process the present water coming from both the outer air and the atmosphere inside the fuel tanks of the service station, eliminating the existence of water in the fuel vapors, which will be processed by means of condensation and liquefaction in a second module of the cryogenic vaporizer 11B for the use and sale thereof.

In this module 10, a safety shunt 12 is installed by means of manual valves. This shunt 12 makes it possible to prevent the passage of the vapors through the condensation module 10 in order to carry out installation, maintenance and repair work without affecting the operation of the service station. This shunt 12 also regulates the passage of vapors to the inside of the chamber 13, as well as the outlet thereof from the cryogenic condensation chamber 13.

In the shunt, there is a safety path 14 that acts in the case of mechanical blockage in the condensation chamber 13 when the flow of vapors goes from the tank 2 of the station to a vent valve 6 arranged on the end of an outlet pipe 7. This safety path 14 makes it possible to ensure the outlet of the vapors in any case of blockage.

The condensation module 10 further comprises a safety valve 15, that ensures that the air is taken from the outside in the case of blockage of the condensation chamber 13 and thus allows for the perfect operation of the service station when a depression is created in the ventilation during the sales processes of the fuel.

Arranged in the lower part of the condensation chamber 13 is a collection tank 16 where the liquefied fuel resulting from the condensation of the vapors is stored. This collection tank 16 contain a measuring system that indicates the amount of existing fuel. This measuring system makes it possible to obtain information about the working conditions of the system and see the particular features of each installation and optimize efficiency according to the specific needs of the installation.

Arranged in the lower part of the condensation chamber 13 is also an overfill safety pipe 17 that makes it possible to remove the liquid that passes from a maximum level through the return pipe 18 to the main tank of the station.

Arranged at the bottom of the tank are also manual valves 19 that allow for the manual extraction of the product of this collection tank 16 for the measurement and checking thereof by the technicians and qualified personnel.

Moreover, placed in this collection tank 16 is a solenoid valve 29 controlled by management means that automatically unload the fuel existing in this collection tank 16, according to the configuration, to tank 2 of the station for the use and sale thereof.

Arranged in said chamber 13 is the aforementioned cryogenic vaporizer 11, placed so that the vapors pass through it, radically changing the temperature thereof instantly. This vaporizer 11 is controlled and managed from the compression module 20. This cryogenic vaporizer 11 condenses the vapors, liquefying the fuel contained therein, precipitating them by gravity to the collection tank 16.

Incorporated into the cryogenic vaporizer 11 is a coalescing mesh 22 in series with said first and second modules 11A and 11B, which makes it possible to process the vapors that, due to the rate at which the vapor passes, they have not been condensed in the vaporizer 11. This element makes it possible to conglomerate the remaining molecules in the vapors, as well as group together drops of fuel that will finally be precipitated to the collection tank 16, making the system more effective.

In the cryogenic vaporizer 11 and in the outlet of the condensation chamber there are two temperature probes which indicate the temperature inside the chamber 13 that makes it possible to see the operation of the system and the efficiency thereof. The control means that govern the operation of the system require these temperature probes to manage the operating cycles and modulate the working temperatures.

The outer part of the chamber 13 is coated with an insulating element that allows for greater energy efficiency, as well as a protective ventilated wall that has two purposes: maintain the temperature of the outside of the chamber 13 as low as possible, creating an air current and protecting the chamber 13 from external effects, and mechanical protection.

The compression module 20 of the system according to the present invention is formed by a metal casing 23 separated from the condensation module 10 at a distance according to safety specifications and by classified areas.

Inside this casing 23, there is at least one compressor 24, along with mechanical devices needed to cool the cryogenic vaporizer 11 installed in the condensation module 10.

This compressor 24 is governed by control means 25. These control means 25 manage the operation of the compressor 24 according to the needs of the condensation chamber 13 that it obtains through the temperature probes arranged therein.

These control means 25 govern the parameters needed to prevent the blockage of the vaporizer 11 caused by ice, this feature being a safety measure and an element to control the creation of water in this system.

The control means 25 further control the volumes and recovery data of the system. These control means receive data from the condensation chamber 13, interpreting the product levels inside the collection tank 16, manage the fuel levels and direct the unloading of the system to the fuel tank 2 of the station, reporting all data to the database thereof.

The control means have an IP address connection that makes it possible to view this data via the Internet.

The system according to the present invention makes it possible to process the water present in the outer air and inside the fuel tanks of the service station. The presence of water in the environment is common in some countries where the humidity level may reach 100%.

Despite the fact that reference has been made to a specific embodiment of the invention, it is evident for the person skilled in the art that numerous variations and changes may be made to the recovery system described, and that all the aforementioned details may be substituted by other technically equivalent ones, without detracting from the scope of protection defined by the attached claims.

The invention claimed is:

1. A system of fuel vapor recovery and use comprising:

a cryogenic condensation module capable of connecting to a fuel tank of a service station by means of a ventilation pipe and a return pipe, wherein a shunt is arranged between the ventilation pipe and an outlet pipe, the shunt capable of blocking fuel vapors from entering a chamber of the cryogenic condensation module, and wherein the cryogenic condensation module comprises:

a cryogenic vaporizer that lowers a temperature of the fuel vapors to condense the fuel vapors into fuel, the cryogenic vaporizer comprising a first module for fractionated condensation of water vapor and a second module for condensation of volatile elements of the fuel vapors, wherein the first module and the second module are at different temperatures; and a processing element that processes the fuel vapors that have not been condensed in the cryogenic vaporizer.

2. The system of claim 1, wherein the processing element is a coalescing mesh.

3. The system of claim 1, wherein the cryogenic condensation module further comprises a collection tank for storing the condensed fuel vapors.

4. The system of claim 1, further comprising at least one safety valve arranged in the ventilation pipe.

5. The system of claim 1, wherein the outlet pipe comprises a vent valve arranged on an end of the outlet pipe.

6. The system of claim 1, wherein the first module and the second module and the processing element are arranged in series for a bidirectionality of the fuel vapors and air that has entered the fuel vapors.

7. The system of claim 1, wherein the cryogenic condensation module is connected to the fuel tank of the service station by the ventilation pipe and the return pipe, wherein the ventilation pipe displaces the fuel vapors from the fuel tank to the cryogenic condensation module, and wherein the return pipe returns the condensed fuel vapors to the fuel tank.

8. The system of claim 1, further comprising a cryogenic compression module that controls the cryogenic vaporizer.

9. The system of claim 8, wherein the cryogenic compression module further comprises at least one compressor connected to the cryogenic vaporizer.

10. The system of claim 1, wherein the return pipe comprises a solenoid valve to automatically unload the condensed fuel vapors to the fuel tank.

11. The system of claim 10, wherein the return pipe comprises at least one manual valve to manually unload the condensed fuel vapors to the fuel tank.

12. A method of fuel recovery and use, the method comprising:

receiving fuel vapors comprising water vapor and volatile elements at a cryogenic vaporizer within a cryogenic condensation module;

blocking the fuel vapors from entering a chamber of the cryogenic condensation module via a shunt that is arranged between a ventilation pipe and an outlet pipe;

condensing the fuel vapors into fuel, using the cryogenic vaporizer, by reducing a first temperature of the water vapor and reducing a second temperature of the volatile elements, wherein the first temperature and the second temperature are different temperatures; and processing the fuel vapors that have not been condensed in the cryogenic vaporizer.

13. The method of claim 12, further comprising:

separating the water vapor and the volatile elements using at least one mesh;

maintaining an outer temperature of the chamber of the cryogenic condensation module; and condensing the fuel vapors using the cryogenic vaporizer.

14. The method of claim 12, further comprising:

connecting the cryogenic condensation module to a fuel tank of a service station via the ventilation pipe and a return pipe;

displacing the fuel vapors from the fuel tank to the cryogenic condensation module;

receiving the fuel vapors at the cryogenic vaporizer;

condensing the fuel vapors using the cryogenic vaporizer; and returning the condensed fuel vapors to the fuel tank via the return pipe.

15. The method of claim 14, further comprising:

removing excess of the condensed fuel vapors that pass a maximum level while returning to the fuel tank via the return pipe.

16. The method of claim 12, wherein the condensing the fuel vapors into fuel further comprises precipitating the condensed fuel vapors by gravity to a collection tank.

17. The method of claim 16, further comprising determining product levels inside the collection tank.

18. A system of fuel vapor recovery and use comprising:

a cryogenic condensation module capable of connecting to a fuel tank of a service station via a ventilation pipe, wherein a shunt is arranged between the ventilation pipe and an outlet pipe, the shunt capable of blocking vapors from entering a chamber of the cryogenic condensation module, and wherein the cryogenic condensation module comprising:

a cryogenic vaporizer that condenses the vapors comprising water vapor and volatile elements of fuel vapor, the cryogenic vaporizer comprising a first module for fractionated condensation of the water vapor and a second module for condensation of the volatile elements of fuel vapor, wherein the first module and the second module condense vapors at different temperatures; and a processing element that processes the vapors that have not been condensed in the cryogenic vaporizer.

19. The system of claim 18, further comprising:

a compression module comprising a metal casing that is separate from the cryogenic condensation module, the compression module at a predetermined distance from the cryogenic condensation module, and wherein the compression model controls the cryogenic condensation module using received condensation data.

* * * * *